US008330564B2

(12) United States Patent
Miller

(10) Patent No.: US 8,330,564 B2
(45) Date of Patent: Dec. 11, 2012

(54) SWITCHING DEVICES CONFIGURED TO CONTROL MAGNETIC FIELDS TO MAINTAIN AN ELECTRICAL CONNECTION

(75) Inventor: Mitchell Eugene Miller, Clemmons, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 130 days.

(21) Appl. No.: 12/773,545

(22) Filed: May 4, 2010

(65) Prior Publication Data

US 2011/0272258 A1 Nov. 10, 2011

(51) Int. Cl.
*H01H 51/22* (2006.01)

(52) U.S. Cl. ..... 335/78; 335/84; 335/128

(58) Field of Classification Search ..... 335/78–86, 335/128, 129

See application file for complete search history.

(56) References Cited

U.S. PATENT DOCUMENTS

| | | | | |
|---|---|---|---|---|
| 5,546,061 | A | 8/1996 | Okabayashi et al. | |
| 5,959,452 | A | 9/1999 | Givens et al. | |
| 6,034,582 | A * | 3/2000 | Fausch | 335/78 |
| 6,292,075 | B1 * | 9/2001 | Connell et al. | 335/185 |
| 6,426,689 | B1 * | 7/2002 | Nakagawa et al. | 335/78 |
| 6,661,319 | B2 * | 12/2003 | Schmelz | 335/78 |
| 7,659,800 | B2 * | 2/2010 | Gruner et al. | 335/78 |
| 2006/0017532 | A1 | 1/2006 | Trutna, Jr. | |
| 2006/0279384 | A1 * | 12/2006 | Takayama et al. | 335/78 |
| 2009/0072935 | A1 | 3/2009 | Yuba et al. | |

FOREIGN PATENT DOCUMENTS

| | | |
|---|---|---|
| DE | 38 37 666 | 5/1990 |
| DE | 40 19 236 | 6/1991 |
| DE | 102 22 668 | 12/2002 |
| DE | 10 2008 048191 | 4/2010 |
| EP | 1 858 038 | 11/2007 |
| EP | 2019405 | 1/2009 |
| WO | WO 98/40898 | 9/1998 |

OTHER PUBLICATIONS

European Search Report, Mail Date Sep. 16, 2011, EP 11 16 4198, Application No. 11164198.1-2214.

* cited by examiner

*Primary Examiner* — Bernard Rojas

(57) ABSTRACT

An electrical switching device including a base terminal that extends substantially in an axial direction and has a base contact. The switching device also includes a movable terminal that extends substantially in the axial direction and has a mating contact. The movable and base terminals extend generally parallel to each other and are separated by a field spacing. The movable terminal is selectively movable to and from the base terminal to electrically connect the base and mating contacts at a contact interface. The switching device also includes a magnetic shield that is located between the movable and base terminals within the field spacing. The movable terminal experiences a separation force when current flows through the base and movable terminals in opposite directions. The magnetic shield is configured to reduce the separation force experienced by the movable terminal to facilitate maintaining the contact interface between the base and mating contacts.

20 Claims, 5 Drawing Sheets

SWITCHING DEVICES CONFIGURED TO CONTROL MAGNETIC FIELDS TO MAINTAIN AN ELECTRICAL CONNECTION

BACKGROUND OF THE INVENTION

The invention relates generally to electrical switching devices that are configured to control the flow of an electrical current therethrough, and more particularly, to switching devices having mating contacts that remain electrically connected during high-current fault conditions or short circuits.

Electrical switching devices (e.g., contactors, relays) exist today for connecting or disconnecting a power supply to an electrical device or system. For example, an electrical switching device may be used in an electrical meter that monitors power usage by a home or building. Conventional electrical devices include a housing that receives a plurality of input and output terminals and a mechanism for electrically connecting the input and output terminals. In some switching devices, a solenoid actuator is operatively coupled to a mating contact of one of the terminals. When the solenoid actuator is activated, the solenoid actuator moves the mating contact toward another mating contact to establish an electrical connection. The solenoid actuator may also be activated to disconnect the mating contacts.

However, if the mating contacts are separated during a high-current fault condition or short circuit, an electric arc may be formed between the mating contacts. The electric arc may have negative effects on the other components of the switching devices and, as such, it may be desirable for switching devices to maintain the electrical connection during such fault conditions. To this end, switching devices may use various mechanisms, such as using mechanical forces that press the mating contacts together. However, because switching devices may have limited available space within the switch housings, conventional mechanical devices may not be suitable or may be too costly for maintaining the electrical connection.

Accordingly, there is a need for electrical switching devices that maintain an electrical connection during high-current fault conditions or short circuits. There is also a general need for electrical switching devices that may reduce the number of components within the switch housing and cost less to manufacture as compared to known switching devices.

BRIEF DESCRIPTION OF THE INVENTION

In accordance with one embodiment, an electrical switching device is provided that includes a base terminal that extends substantially in an axial direction and has a base contact. The switching device also includes a movable terminal that extends substantially in the axial direction and has a mating contact. The movable and base terminals extend generally parallel to each other and are separated by a field spacing. The movable terminal is selectively movable to and from the base terminal to electrically connect the base and mating contacts at a contact interface. The switching device also includes a magnetic shield that is located between the movable and base terminals within the field spacing. The movable terminal experiences a separation force when current flows through the base and movable terminals in opposite directions. The magnetic shield is configured to reduce the separation force experienced by the movable terminal to facilitate maintaining the contact interface between the base and mating contacts.

In accordance with another embodiment, an electrical switching device is provided that includes first and second base terminals that extend substantially in an axial direction and overlap each other with a field spacing therebetween. The switching device includes a movable terminal that is coupled to the second base terminal. The movable terminal extends substantially in the axial direction within the field spacing between the first and second base terminals. The switching device also include a magnetic shield that is located between the movable terminal and the first base terminal. Current flows through the first and second base terminals in a common direction and flows through the movable terminal in an opposite direction when the movable terminal and the first and second base terminals form a closed circuit. The movable terminal experiences a separation force provided by the first base terminal and an opposing magnetic force provided by the second base terminal. The magnetic shield is configured to reduce the separation force experienced by the movable terminal.

DETAILED DESCRIPTION OF THE INVENTION

Figure 1:
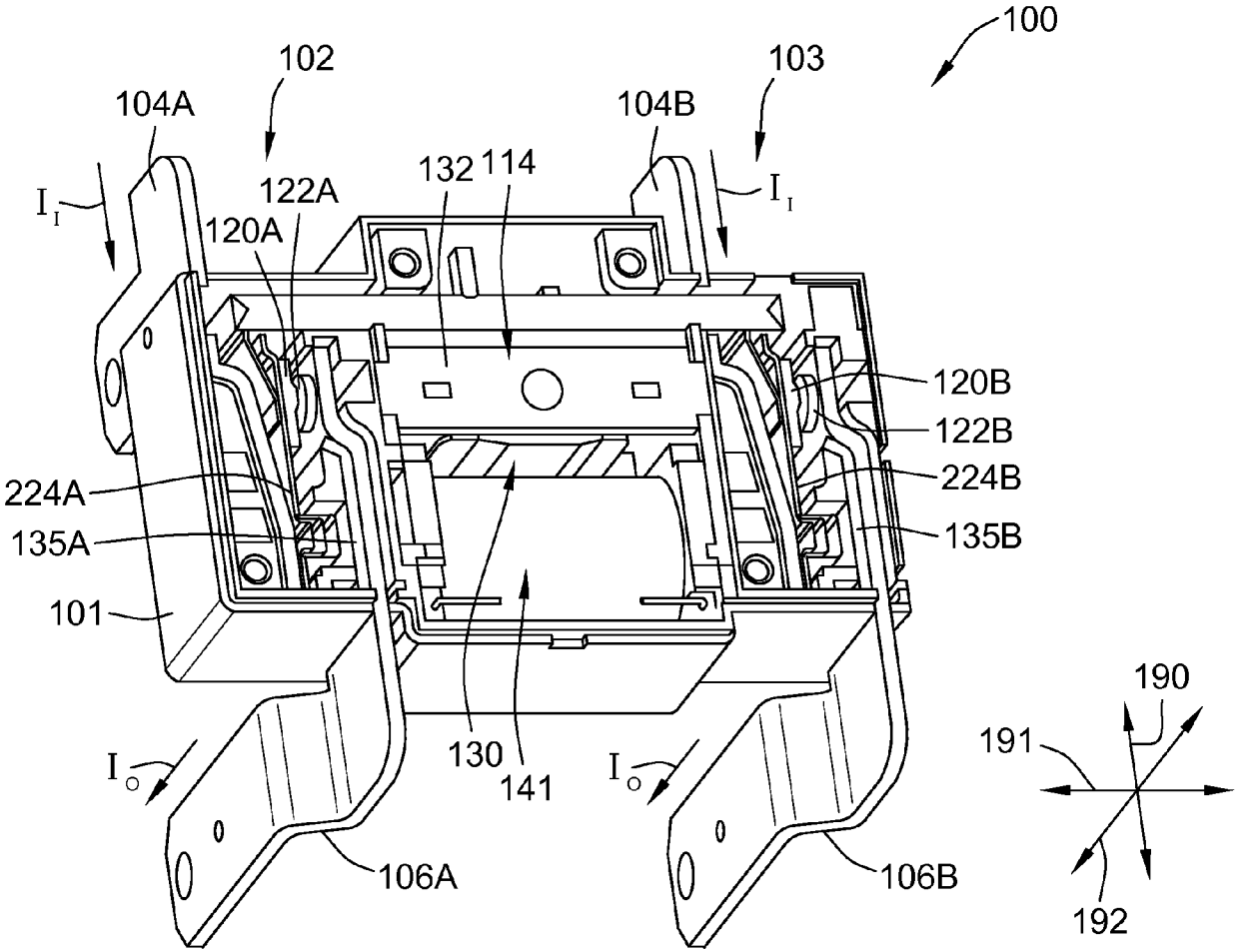
FIG. 1 is an exposed perspective view of an electrical switching device formed in accordance with one embodiment.

FIG. 1 is an exposed perspective view of an electrical switching device 100 formed in accordance with one embodiment. The switching device 100 includes a switch housing 101 that is configured to receive and enclose at least one circuit assembly. (In FIG. 1, a cover of the switch housing 101 has been removed to reveal internal components of the switching device 100.) In the illustrated embodiment, the switching device 100 includes a pair of circuit assemblies 102 and 103. The circuit assemblies 102 and 103 may also be referred to as poles. The circuit assembly 102 includes terminals 104A and 106A, and the circuit assembly 103 includes terminals 104B and 106B. The switch housing 101 may include a plurality of housing sides including a housing side 148 where terminals 104A and 104B are received and a housing side 150 where terminals 106A and 106B are received. The housing sides 148 and 150 may be opposite to one another. However, in alternative embodiments, the base terminals 104A, 104B, 106A, and 106B may enter through different housing sides or through one common housing side.

The base terminals 104A and 106A are configured to electrically connect to each other within the switch housing 101 through mating contacts 120A and 122A, and the base terminals 104B and 106B are configured to electrically connect to each other within the switch housing 101 through mating contacts 120B and 122B. To distinguish the mating contacts 120 and 122, the mating contacts 122 may be referred to as base contacts and the mating contacts 120 may be referred to as movable contacts.

In the illustrated embodiment, the base terminals 104A and 104B are input terminals that receive an electrical current $I_I$ from a utility power source and the base terminals 106A and 106B are output terminals configured to deliver the current $I_O$ to an electrical device or load. In the exemplary embodiment, the base terminals 104 and 106 may be referred to as base or stationary terminals since, in some embodiments, the base terminals 104 and 106 have fixed positions with respect to the switch housing 101. The circuit assemblies 102 and 103 also include movable terminals or elements 224A and 224B, respectively. The movable terminals 224 are configured to be selectively moved between engaged and unengaged positions to electrically connect and disconnect the movable and base contacts 120 and 122. As shown, the base terminals 104A and 106A and the movable terminal 224A may form the circuit assembly 102. Likewise, the base terminals 104B and 106B and the movable terminal 224B may form the circuit assembly 103.

During operation of the switching device 100, current flowing through the circuit assemblies 102 and 103 may generate magnetic fields that affect other components of the switching device 100. For example, when the movable and base contacts 120 and 122 are electrically connected, the magnetic fields generated by the current flowing therethrough may exert a mating force on the movable terminals 224 that acts to press the associated movable and base contacts 120 and 122 together and/or a separation force that opposes the mating force and acts to separate the associated movable and base contacts 120 and 122. Embodiments described herein may be configured to control or affect such forces. For example, embodiments described herein may reduce the separation force so that the movable and base contacts 120 and 122 remain electrically connected during, for example, a high-current fault condition or short circuit. In particular embodiments, the separation forces are reduced by magnetic shields 135A and 135B.

As shown in FIG. 1, the switching device 100 is oriented with respect to mutually perpendicular axes 190-192 or, more specifically, a longitudinal axis 190, a mating axis 191, and a lateral axis 192. In addition to the circuit assemblies 102 and 103, the switching device 100 may also include an actuator device 114 and a coupling element 116. The actuator device 114 is illustrated as an electromechanical motor that includes a pivot assembly 130 and a coil assembly 141. The coupling element 116 is operatively coupled to the pivot assembly 130 and is also operatively coupled to the movable terminals 224A and 224B. The actuator device 114 may be activated to move the coupling element 116 thereby moving the movable terminals 224A and 224B to electrically connect or disconnect the movable and base contacts 120 and 122. Also shown, the pivot assembly 130 may include a pivot stabilizer 132 that supports the pivot assembly 130.

The switching device 100 is configured to selectively control the flow of current through the circuit assemblies 102 and 103. For example, the switching device 100 may be used with an electrical meter of an electrical system for a home or building. Current enters the switch housing 101 through the base terminals 104A and 104B and exits the switch housing 101 through the base terminals 106A and 106B. In some embodiments, the switching device 100 is configured to simultaneously connect or disconnect the movable and base contacts 120A and 122A and the movable and base contacts 120B and 122B. Although the illustrated switching device 100 includes two circuit assemblies 102 and 103, in other embodiments, the switching device 100 may include only one circuit assembly or more than two circuit assemblies. Also, by way of example only, during normal operation of the switching device 100, the current flowing therethrough may be about 200 A (approximately 100 A per circuit assembly). During a high-current fault condition or short circuit, the current flowing therethrough may be about 1200 A.

In some embodiments, the switching device is communicatively coupled to a remote controller (not shown). The remote controller may communicate instructions to the switching device 100. The instructions may include operating commands for activating or inactivating the actuator device 114. In addition, the instructions may include requests for data regarding usage or a status of the switching device 100 or usage of electricity.

Figure 2:
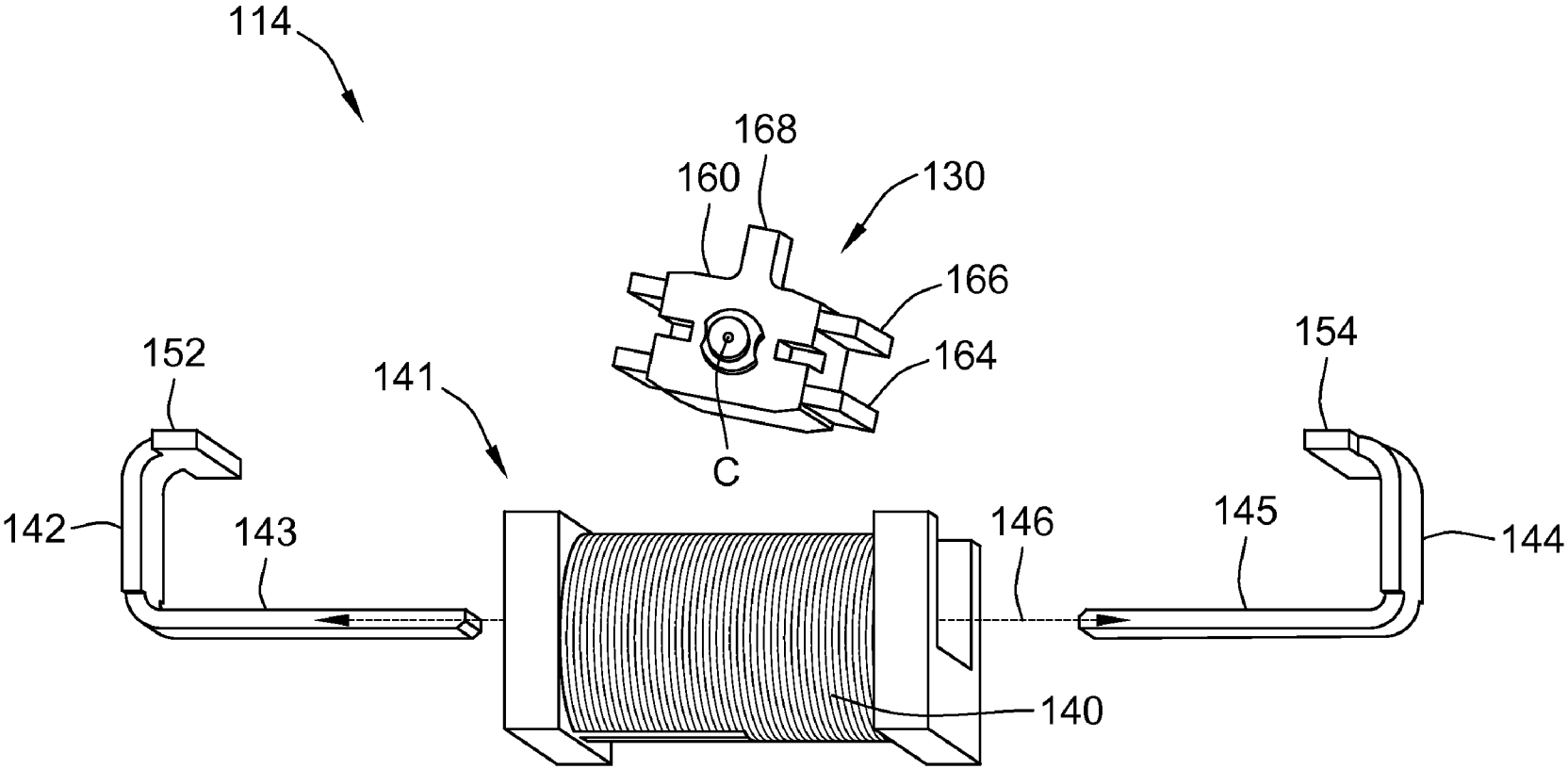
FIG. 2 is an exploded view of an actuator device that may be used in the switching device of FIG. 1.

FIG. 2 is an exploded view of the actuator device 114. In the exemplary embodiment, the actuator device 114 generates a predetermined magnetic flux or field to control the movement of the coupling element 116 (FIG. 1). For example, the actuator device 114 may be a solenoid actuator. The actuator device 114 may include the pivot assembly 130 and the coil assembly 141. The pivot assembly 130 and the coil assembly 141 and their operation together are described in greater detail in U.S. application Ser. No. 12/549,176, filed on Aug. 27, 2009, and entitled "ELECTRICAL SWITCHING DEVICES HAVING MOVABLE TERMINALS", which is hereby incorporated by reference in the entirety. The coil assembly 141 includes an electromagnetic coil 140 and a pair of yokes 142 and 144. The coil 140 extends along and wraps about a coil axis 146, which may extend parallel to the mating axis 191 shown in FIG. 1. The yokes 142 and 144 include legs 143 an 145, respectively, that are inserted into a cavity (not shown) of the coil 140 and extend along the coil axis 146. The yokes 142 and 144 include yoke ends 152 and 154 that are configured to magnetically couple to the pivot assembly 130 to control rotation of the pivot assembly 130. When the coil 140 is activated, a magnetic field is generated that extends through the coil assembly 141 and the pivot assembly 130. In the exemplary embodiment, the magnetic field has a looping shape. A direction of the field is dependent upon the direction of the current flowing through the coil 140. Based upon the direction of the current, the pivot assembly 130 will move to one of two rotational positions.

The pivot assembly 130 includes a pivot body 160 that holds a permanent magnet (not shown) therein and a pair of armatures 164 and 166. The permanent magnet may have opposite North and South poles or ends that are each positioned proximate to a corresponding one armature 166 and 164, respectively. The armatures 164 and 166 may be positioned with respect to each other and the permanent magnet to form a predetermined magnetic flux for selectively rotating the pivot assembly 130. Also shown, the pivot body 160 includes a projection or post 168 that projects radially away from a center of rotation C of the pivot body 160.

Figure 3:
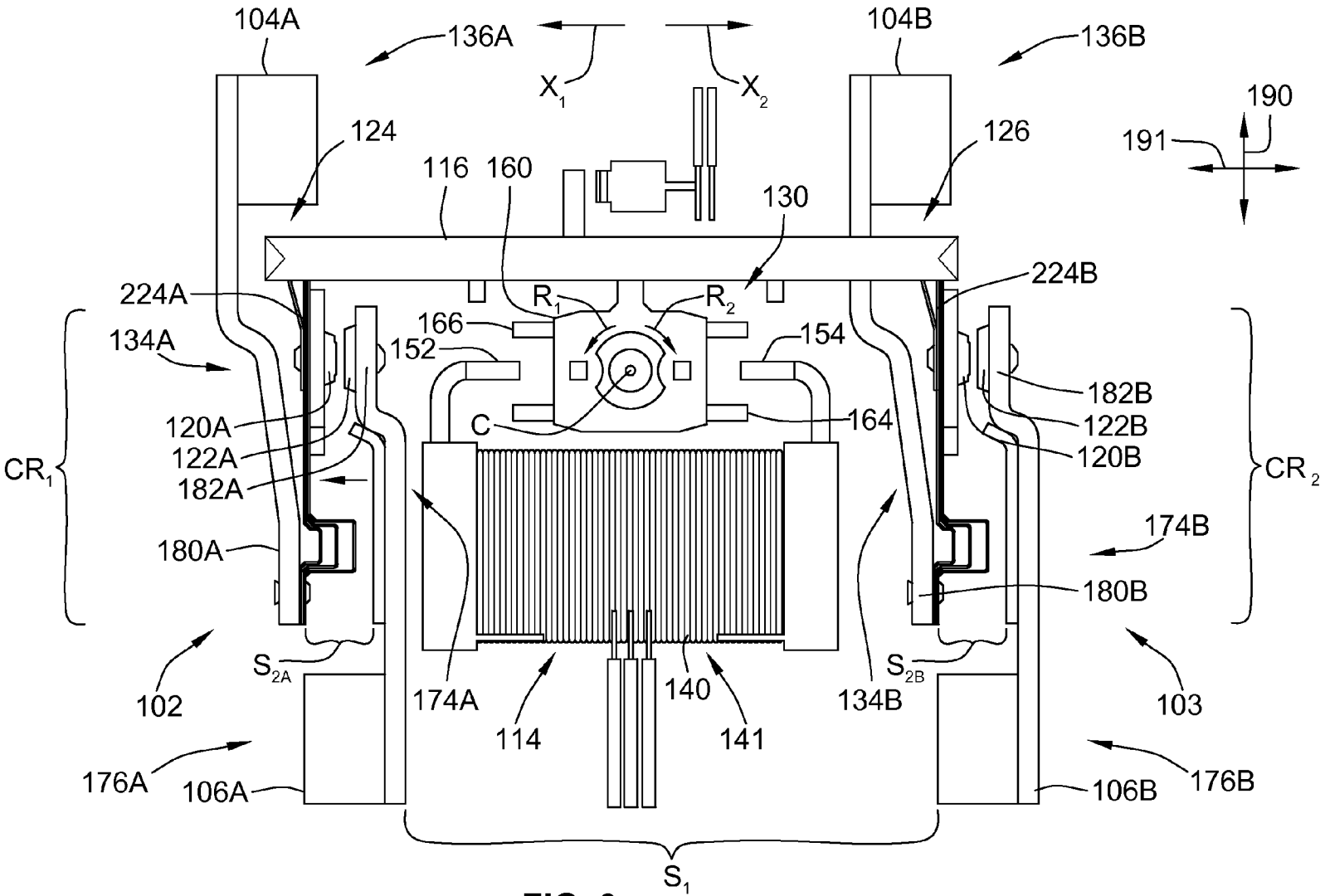
FIG. 3 is a plan view of an arrangement of internal components used by the switching device of FIG. 1.

FIG. 3 shows an arrangement of internal components of the switching device 100 in which the switch housing 101 and the pivot stabilizer 132 from FIG. 1 have been removed for illustrative purposes. In some embodiments, the components housed by the switch housing 101 are held within a confined spatial region. For example, the circuit assemblies 102 and 103 are separated by an interior space $S_1$. The actuator device 114 is located within the interior space $S_1$ between the circuit assemblies 102 and 103. The pivot assembly 130 and the coil assembly 141 are located generally between and equidistant from the circuit assemblies 102 and 103. In the illustrated embodiment, the coupling element 116 extends across the interior space $S_1$ in a direction along the mating axis 191 and is operatively coupled to each of the movable terminals 224A and 224B. More specifically, the coupling element 116 has opposite element end portions 124 and 126. The element end portions 124 and 126 may have slots or openings (not shown) that are configured to receive the movable terminals 224A and 224B, respectively.

Also shown, the base terminals 104 and 106 extend in a substantially axial direction along the longitudinal axis 190. The base terminal 104A includes an exterior portion 136A located outside of the switch housing 101 and an interior portion 134A located within the switch housing 101. The base terminal 104B includes an exterior portion 136B located outside of the switch housing 101 and an interior portion 134B located within the switch housing 101. Similarly, the base terminals 106 include an exterior portion 176 located outside of the switch housing 101 and an interior portion 174 located within the switch housing 101. The base terminals 104A and 104B also include terminal end portions 180A and 180B, respectively. The base terminals 104A and 104B may couple to the movable terminals 224A and 224B proximate to the terminal end portions 180A and 180B, respectively. In addition, the base terminals 106A and 106B include terminal end portions 182A and 182B, respectively. The terminal end portions 182A and 182B have the base contacts 122A and 122B, respectively, attached thereto.

Also shown in FIG. 3, the movable terminals 224 extend substantially in the axial direction to the corresponding movable contacts 120. Associated movable and base terminals 104 and 106 (i.e., movable and base terminals of one circuit assembly) may extend generally parallel to each other and be separated by a field spacing $S_2$. Also shown, the magnetic shields 135 are located between the movable and base terminals 224 and 106 within the field spacing $S_2$. With specific reference to the circuit assembly 102, the base terminals 104A and 106A and the movable terminal 134A may overlap each other within the switch housing 101. More specifically, the interior portion 134A of the base terminal 104A, the movable terminal 224A, and the interior portion 174A of the base terminal 106A may extend side-by-side with each other. The overlapping terminals are located within a coupling region $CR_1$ in which the magnetic fields generated by the terminals when current flows therethrough interact with each other. Also shown, the circuit assembly 103 may have a coupling region $CR_2$ that is similar to the coupling region $CR_1$. As will be described in greater detail below, the magnetic fields create forces that act upon the movable terminal 224. The forces may be controlled to facilitate maintaining an electrical connection between associated movable and base contacts 120 and 122.

To open and close the circuit assemblies 102 and 103, the pivot assembly 130 may be activated to move to a different rotational position. When the pivot assembly 130 is rotated between different rotational positions, the movable terminals 224A and 224B are simultaneously moved. By way of example, when the actuator device 114 receives a positive signal, the coil 140 may be activated to generate a magnetic field through the yoke ends 152 and 154 and the armatures 164 and 166. The pivot body 160 may rotate about the center of rotation C in a direction $R_1$ (shown as counter-clockwise in FIG. 3) until the pivot body 160 reaches a disengaged rotational position. The post 168 moves (i.e., translates) the coupling element 116 in a linear manner in a direction along the mating axis 191. More specifically, the coupling element moves in an axial direction $X_1$. After the pivot body 160 reaches the disengaged rotational position, the positive signal may be deactivated. With the coil 140 deactivated, the permanent magnet (not shown) may then maintain the rotational position through magnetic coupling. In the disengaged rotational position, associated movable and base contacts 120 and 122 are spaced apart from each other to form an open circuit (i.e., the movable and base contacts 120 and 122 are electrically disconnected).

When the actuator device 114 receives a negative signal, the coil 140 may be activated to generate an opposite magnetic field through the yoke ends 152 and 154 and the armatures 164 and 166. The pivot body 160 may then rotate in a direction $R_2$ (shown as clockwise in FIG. 3) about the center of rotation C until the pivot body 160 reaches an engaged rotational position. As shown, the post 168 would move the coupling element 116 in an axial direction $X_2$ that is opposite the axial direction $X_1$. When the pivot body 160 is in the engaged rotational position, associated movable and base contacts 120 and 122 are electrically connected to each other. After the pivot body 160 has reached the desired rotational position, the negative signal may be deactivated. Thus, the pivot body 160 may be moved between different rotational positions by rotating bi-directionally about the center of rotation C thereby moving the coupling element 116 bi-directionally in a linear manner along the longitudinal axis 190. Accordingly, the rotational motion of the pivot assembly 130 may be translated into linear motion along the longitudinal axis 190 for moving the movable terminals 224A and 224B.

Figure 4:
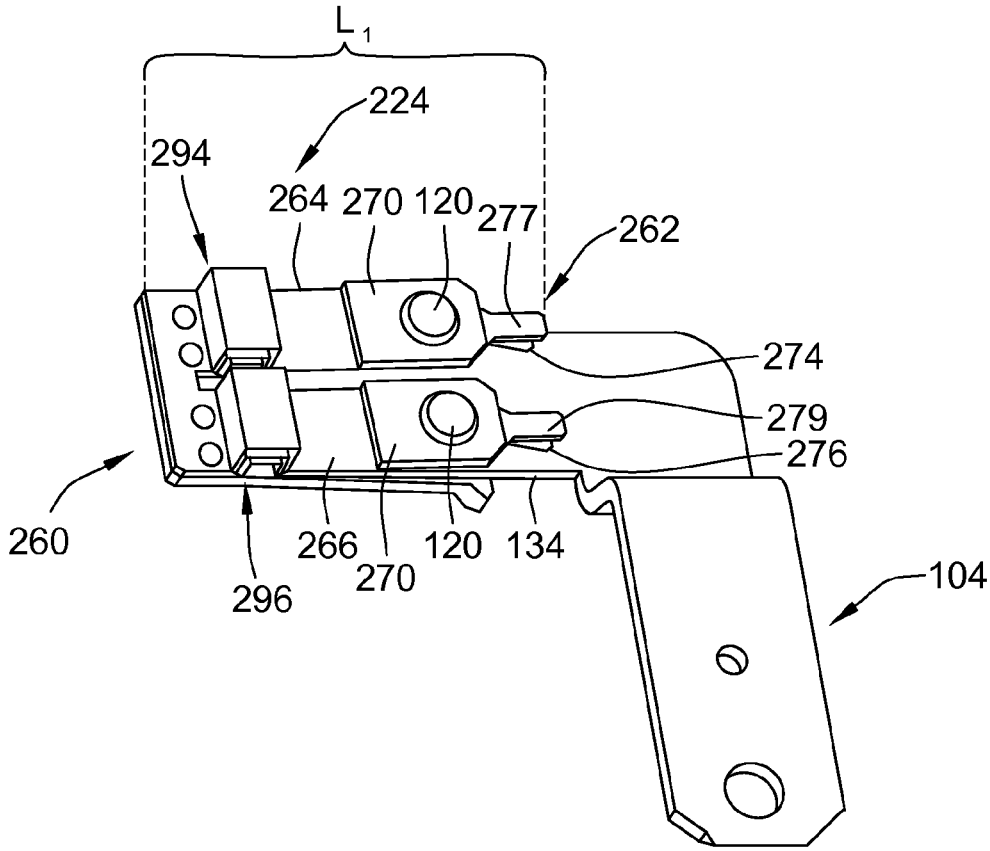
FIG. 4 is a perspective view of base and movable terminals coupled together for use in the switching device of FIG. 1.
Figure 5:
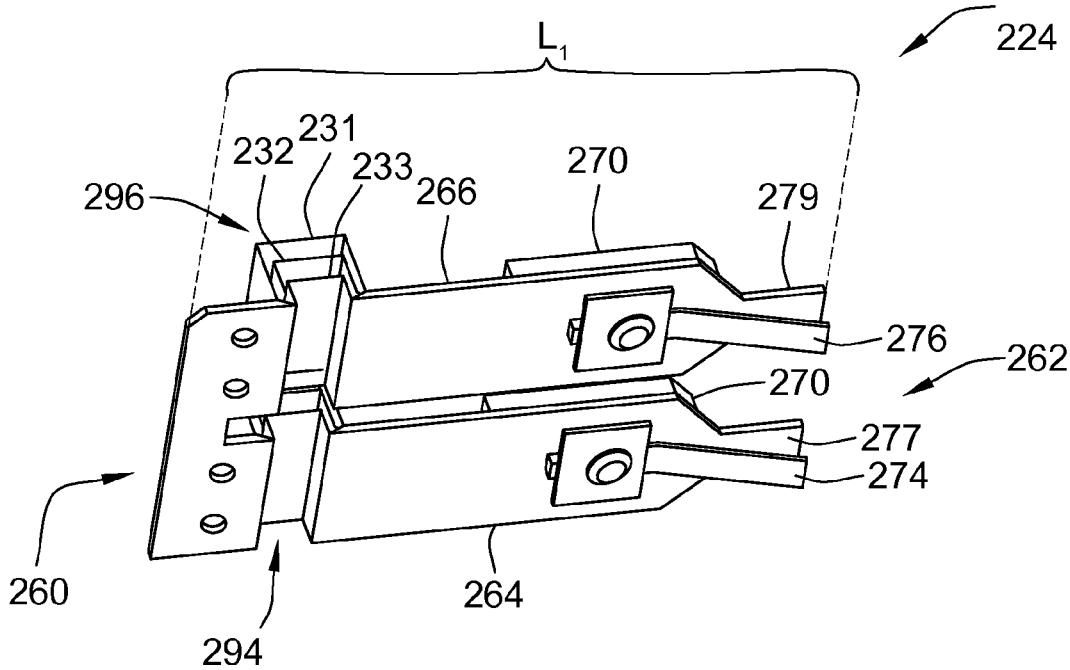
FIG. 5 is an isolated perspective view of the movable terminal that may be used with the switching device of FIG. 1.

FIGS. 4 and 5 illustrate an exemplary movable terminal 224 in greater detail. FIG. 4 is a perspective view of the base terminal 104 and the corresponding movable terminal 224 coupled together, and FIG. 5 is an isolated perspective view of the movable terminal 224. The movable terminal 224 has a length $L_1$ that extends between two terminal ends 260 and 262. The terminal end 260 is secured to the base terminal 104 using fasteners, such as rivets or resistive welding. As shown in FIG. 4, the housing portion 134 that extends generally along the movable terminal 224. The exterior portion 136 may be configured to electrically engage another component, such as an electrical meter. Although the exterior portion 136 is shown as extending substantially perpendicular to the housing portion 134, the exterior portion 136 may have other configurations in alternative embodiments.

As shown in FIGS. 4 and 5, the movable terminal 224 includes bifurcated conductive paths 264 and 266 with a gap $G_1$ therebetween. By way of example only, the movable terminal 224 may be configured to transmit 100 A in which 50 A flows through each conductive path 264 and 266. The conductive paths 264 and 266 are joined together at the terminal end 260. The conductive paths 264 and 266 are not joined together at the terminal end 262, but instead extend to separate end tabs 277 and 279, respectively. The coupling element 116 (FIG. 1) may be configured to grip the end tabs 277 and 279. Each conductive path 264 and 266 is electrically coupled to a corresponding movable contact 120 (FIG. 4). Also shown, the movable terminal 224 includes heat sinks 270 on the conductive paths 264 and 266. The heat sinks 270 may be welded to the corresponding conductive path. The heat sink 270 may be in direct contact with the corresponding movable contact 120. For example, the heat sink 270 may directly surround the movable contact 120 or may have the movable contact 120 directly attached thereon. The heat sinks 270 are configured to facilitate distributing the heat generated by the current flowing through the movable terminal 224 and the contact 120. As shown, the heat sinks 270 may extend lengthwise along the conductive paths 264 and 266.

Each conductive path 264 and 266 may be formed from a plurality of separate layers 231-233 that are stacked with respect to each other and secured together. The conductive paths 264 and 266 may also form flex regions 294 and 296. As shown in FIG. 5, the layers 231-233 may be spaced apart from each other at the flex regions 294 and 296. For example, the layers 231-233 at the corresponding flex region may extend different distances away from a linear portion of the corresponding conductive path. The layers 231-233 at the corresponding flex region may be substantially C-shaped. The layer 233 may be surrounded by the layer 232 and 231, and the layer 232 may be surrounded by the layer 231. In operation, the separate layers 231-233 at the flex regions 294 and 296 may provide flexibility to the corresponding conductive path so that the movable terminal 224 may be moved about the flex regions 294 and 296. In alternative embodiments, the conductive paths 264 and 266 may not include flex regions with multiple layers, but may, for example, include flex regions having only a single layer that is curved or C-shaped.

Also shown, the movable terminal 224 may include auxiliary biasing elements 274 and 276 that are coupled to and extend alongside the conductive paths 264 and 266, respectively. The biasing elements 274 and 276 may be fastened or formed with the conductive paths 264 and 266, respectively, and located proximate to the terminal end 262 or end tabs 277 and 279. The biasing elements 274 and 276 may also be referred to as spring elements or spring fingers. The biasing elements 274 and 276 comprise a resilient material that permits the biasing elements 274 and 276 to flex to and from the terminal end 262 or, more specifically, the respective end tabs 277 and 279. As shown in FIGS. 4 and 5, the biasing elements 274 and 276 are in a relaxed. When the biasing elements 274 and 276 are engaged and moved toward the end tabs 277 and 279 in a compressed condition, the biasing elements 274 and 276 may provide a biasing force $F_B$ (FIG. 6) that is directed away from the movable terminal 224.

In alternative embodiments, the movable terminal 224 does not include bifurcated paths and multiple mating contacts. For example, in one alternative embodiment, the movable terminal 224 may include only one conductive path that extends from the terminal end to a single mating contact. In another alternative embodiment, the movable terminal 224 may include only one conductive path that extends from the terminal end to a plurality of mating contacts.

Figure 6:
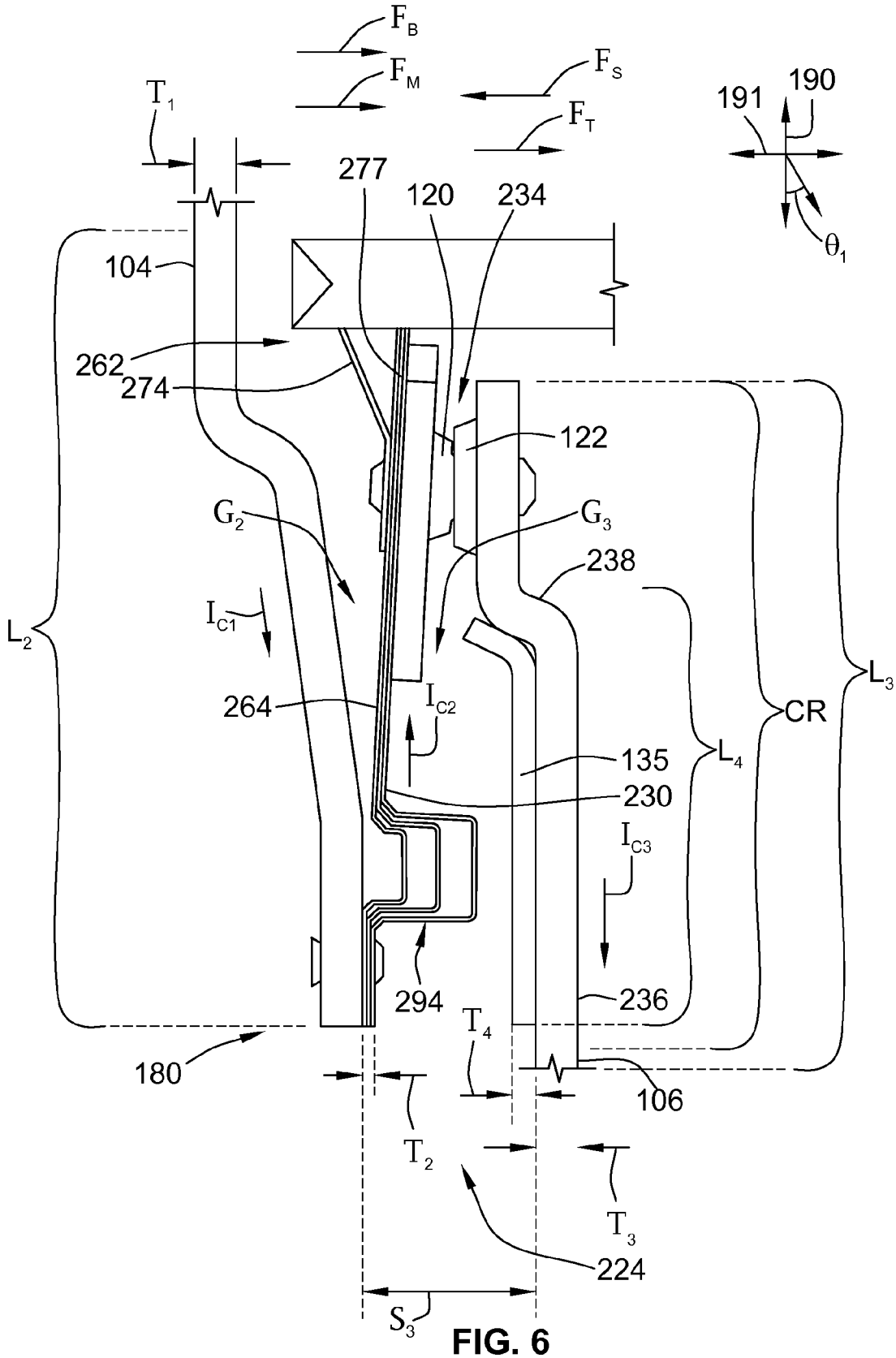
FIG. 6 is an enlarged plan view of an exemplary circuit assembly that may be used with the switching device of FIG. 1.

FIG. 6 is an enlarged plan view of an exemplary circuit assembly, such as the circuit assemblies 102 and 103 (FIG. 1). When the movable and base contacts 120 and 122 are electrically connected, the coupling element 116 engages the biasing element 274 and moves the biasing element 274 toward the end tab 277. As such, the biasing element 274 is in the compressed condition and provides a biasing force $F_B$ in a direction along the mating axis 191 that facilitates pressing the movable contact 120 against the base contact 122.

Also shown, the base terminals 104 and 106 and the movable terminal 224 extend generally or substantially parallel to one another along the longitudinal axis 190 in the coupling region CR. In the exemplary embodiment, the base terminals 104 and 106 and the movable terminal 224 are configured to utilize magnetic forces (also called Lorentz or Ampere's forces) to facilitate maintaining the electrical connection between the movable and base contacts 120 and 122. The magnetic forces are generated by the current I flowing through the circuit assembly. A magnitude and direction of the magnetic forces are based on various factors, such as dimensions of the terminals, relative distances between the terminals, and an amount of current I flowing therethrough.

In the illustrated embodiment, the base terminal 104 has a thickness $T_1$, a width (not shown), and a length $L_2$. The base terminals 104 and 106 may extend generally or substantially parallel to one another. For example, the base terminal 104 may enter the switch housing 101 (FIG. 1) and extend at a non-orthogonal angle $\theta_1$ toward the base terminal 106. The angle $\theta_1$ may be, for example, about 5-10°. However, in alternative embodiments the angle is less than 5° or greater than 10° or the base terminal 104 may extend parallel to the base terminal 106. The terminal end portion 180 of the base terminal 104 and the terminal end 260 of the movable terminal 224 may be secured to one another.

The movable terminal 224 has a thickness $T_2$, a width (not shown), and the length $L_1$ (FIG. 4). The movable terminal 224 includes the conductive path 264 and has the flex region 294 and a linear region 230. The linear region 230 extends substantially parallel to the base terminals 104 and 106 and extends to the terminal end 262. The movable contact 120 may electrically connect to the base contact 122 at a contact interface 234. Likewise, the base terminal 106 has a thickness $T_3$, a width (not shown), and a length $L_3$. The base terminal 106 may enter the switch housing 101 and extend toward the base contact 122 substantially parallel to the base terminal 104 and the movable terminal 224. For example, the base terminal 106 may include a linear portion 236 that extends parallel to the longitudinal axis 190 and a contact portion 238 that curves or jogs toward the movable terminal 224 and then extends parallel to the longitudinal axis 190.

As shown, the base terminals 104 and 106 are separated by a field spacing $S_3$. The field spacing $S_3$ at different portions of the base terminals 104 and 106 may have different separation distances between base terminals 104 and 106. The movable terminal 224 is located within the field spacing $S_3$ between the base terminals 104 and 106. Also shown, the movable terminal 224 may be separated from the base terminal 104 by a gap $G_2$ and separated from the base terminal 106 by a gap $G_3$. The gaps $G_2$ and $G_3$ may have different separation distances from the movable terminal 224 at different portions along the base terminals 104 and 106. The movable terminal 224 is proximate to the base terminals 104 and 106 such that magnetic forces that are sufficient to affect a position or stability of the movable terminal 224 may be generated. As shown, the flex region 294 projects toward the base terminal 106 and the magnetic shield 135.

As shown in FIG. 6, the lengths $L_2$, $L_1$ (FIG. 4), $L_4$, and $L_3$ of the base terminal 104, the movable terminal 224, the magnetic shield 135, and the base terminal 106, respectively, extend substantially along the longitudinal axis 190. The lengths $L_2$, $L_1$, $L_4$, and $L_3$ may be arranged side-by-side and spaced apart from each other. The lengths $L_2$, $L_1$, $L_4$, and $L_3$ may overlap portions of each other.

FIG. 6 also illustrates a flow of current through the corresponding circuit assembly. The base terminal 104 and the movable terminal 224 are arranged with respect to each other such that the current $I_{C1}$ extending through the base terminal 104 is flowing in an opposite direction with respect to the current $I_{C2}$ flowing through the movable terminal 224. Likewise, the base terminal 106 and the movable terminal 224 are arranged with respect to each other such that the current $I_{C2}$ extending through the movable terminal 224 is flowing in an opposite direction with respect to the current $I_{C3}$ flowing through the base terminal 106. As such, the currents $I_{C1}$ and $I_{C3}$ flow in a generally common direction. The current $I_{C2}$ transmits through the separate layers 231-233 (FIG. 5) of the flex region 294 toward the movable contact 120.

Accordingly, a magnetic force $F_M$ may be generated between the base terminal 104 and the movable terminal 224 that acts to move the movable terminal 224 toward the base terminal 106. The magnetic force $F_M$, or at least a portion thereof, is directed in a direction along the mating axis 191 toward base terminal 106. More specifically, the magnetic force $F_M$ is configured to press the movable contact 120 against the base contact 122 when the movable and base contacts 120 and 122 are electrically connected thereby facilitating the electrical connection. Likewise, a separation force $F_S$ may be generated between the base terminal 106 and the movable terminal 224 that acts to move the movable terminal 224 toward the base terminal 104. The separation force $F_S$ is also a magnetic force directed along the mating axis 191, but the separation force $F_S$ opposes the magnetic force $F_M$. More specifically, the separation force $F_s$ acts to repel the movable contact 120 away from the base contact 122 when the movable and base contacts 120 and 122 are electrically connected. In addition to the magnetic force $F_M$, the biasing force $F_B$ acts to press the movable contact 120 against the base contact 122. Accordingly, a resultant or total mating force $F_T$ is applied to the movable contact 120 to maintain an electrical connection between the movable and base contacts 120 and 122. The resultant mating force $F_T$ includes the magnetic force $F_M$ and the biasing force $F_B$ and is reduced by the separation force $F_S$. The magnetic force $F_M$ and the biasing force $F_B$ may also be referred to as mating forces since the magnetic force $F_M$ and the biasing force $F_B$ act to mate or electrically connect the movable and base contacts 120 and 122.

The magnetic shield 135 may be configured to effectively reduce the separation force $F_S$ experienced by the movable terminal 224 to facilitate maintaining the electrical connection between the base and movable contacts 120 and 122. For example, the magnetic shield 135 may have a thickness $T_4$, a length $L_4$, a width (not shown), and comprise a material configured to reduce or disturb the separation force $F_S$. The magnetic shield 135 may comprise a different material other than the terminals 104 and 224. For example, the magnetic shield 135 may comprise steel. In some embodiments, the magnetic shield 135 is positioned immediately adjacent to the base terminal 106 and extends alongside the base terminal 106 in the axial direction toward the base contact 122. For example, the magnetic shield 135 may directly abut the base terminal 106 and be attached to the base terminal 106 through, for example, an adhesive. In some embodiments, the magnetic shield 135 may be inserted between the base terminal and a housing feature (e.g., a portion of the insulative material that comprises the switch housing 101) as shown in FIG. 1.

Accordingly, embodiments described herein may be configured to control various forces to facilitate maintaining an electrical connection between the movable and base contacts. For example, the dimensions of the base terminals 104 and 106, the movable terminal 224, and the magnetic shield 135 may be configured for a desired performance, including the lengths $L_2$, $L_1$, $L_4$, and $L_3$. Similarly, the spacing $S_3$ and the gaps $G_2$ and $G_3$ may be configured for a desired performance.

It is to be understood that the above description is intended to be illustrative, and not restrictive. Furthermore, the above-described embodiments (and/or aspects thereof) may be used in combination with each other. In addition, many modifications may be made to adapt a particular situation or material to the teachings of the invention without departing from its scope. While the specific components and processes described herein are intended to define the parameters of the various embodiments of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical switching device comprising:

a base terminal extending substantially in an axial direction and having a base contact;

a movable terminal extending substantially in the axial direction and having a movable contact, the movable and base terminals extending generally parallel to each other and being separated by a field spacing, the movable terminal being selectively movable to and from the base terminal to electrically connect the base and movable contacts at a contact interface, wherein current flows in opposite directions through the base and movable terminals during operation of the switching device thereby generating an Ampere's separation force that acts to separate the movable and base terminals; and a magnetic shield located between the movable and base terminals within the field spacing, the magnetic shield comprising a magnetic material that reduces the separation force experienced by the movable terminal during operation of the switching device to facilitate maintaining the contact interface between the base and movable contacts.

2. The switching device in accordance with claim 1, wherein the magnetic shield is positioned immediately adjacent to the base terminal and extends alongside the base terminal in the axial direction toward the base contact.

3. The switching device in accordance with claim 1, wherein the movable terminal includes a flex region and a conductive path, the conductive path extending from the flex region to the movable contact, the base terminal extending along the conductive path from the flex region to the movable contact.

4. The switching device in accordance with claim 1, wherein the movable contact is biased against the base contact by a mating force when electrically connected at the contact interface, the mating and separation forces substantially opposing each other.

5. The switching device in accordance with claim 1, wherein the base terminal is a first base terminal and the switching device further comprises a second base terminal that extends along and is electrically connected to the movable terminal, the movable terminal and the first and second base terminals being substantially coplanar, the movable terminal being located between the first and second base terminals, wherein during operation of the switching device the current flows through the second terminal and the movable terminal in opposite directions thereby generating an Ampere's mating force that facilitates biasing the movable contact against the base contact.

6. The switching device in accordance with claim 5, wherein the first and second base terminals extend in opposite directions to respective terminal end portions, the first and second base terminals overlapping each other such that the terminal end portions are separated by a longitudinal distance, the movable terminal extending from the terminal end portion of the second base terminal toward the terminal end portion of the first base tenninal.

7. The switching device in accordance with claim 1 further comprising an actuator device operatively coupled to the movable terminal, the actuator device selectively moving the movable terminal to electrically connect and disconnect the movable and base contacts.

8. The switching device of claim 7, wherein the actuator device comprises an electromechanical motor that includes a pivot assembly and a coil assembly, the switching device further comprising a coupling element that operatively couples the pivot assembly and the movable terminal.

9. The switching device in accordance with claim 1, wherein the movable terminal includes a flex region, the movable terminal pivoting about the flex region when selectively moved to and from the base terminal.

10. The switching device in accordance with claim 1, wherein the movable terminal includes a flex region having a plurality of separate layers, the current being transmitted through the separate layers toward the movable contact.

11. The switching device in accordance with claim 1, wherein the movable terminal includes a biasing element located proximate to the movable contact, the biasing element providing a biasing force in a direction toward the base contact.

12. The switching device in accordance with claim 1, wherein the movable and base contacts remain electrically connected to each other during a high-current fault condition or short circuit in which about 12,000 A flows through the movable and base terminals.

13. The switching device of claim 1, wherein the movable and base terminals extend generally parallel to and co-planar with respect to each other for an overlapping distance, the magnetic shield having a length that is greater than half the overlapping distance.

14. The switching device of claim 1, wherein the magnetic shield extends lengthwise along a non-linear shield path and the base terminal extends lengthwise along a non-linear terminal path, the shield path having a contour that is similar to the terminal path such that the magnetic shield has a shape that conforms to the base terminal.

15. The switching device of claim 1, wherein the magnetic shield has a body comprising a substantially uniform thickness of the magnetic material.

16. An electrical switching device comprising:

first and second base terminals extending substantially in an axial direction and overlapping each other with a field spacing therebetween;

a movable terminal coupled to the second base terminal, the movable terminal extending substantially in the axial direction within the field spacing between the first and second base terminals, wherein, during operation of the switching device, current flows in opposite directions through the first base terminal and the movable terminal thereby generating an Ampere's separation force that acts to separate the movable terminal and the first base terminal; and a magnetic shield comprising a magnetic material and being located between the movable terminal and the first base terminal, the movable terminal experiencing an Ampere's mating force caused by the current flowing through the second base terminal during operation of the switching device, the magnetic shield reducing the separation force experienced by the movable terminal during operation of the switching device.

17. The switching device in accordance with claim 16, wherein the movable terminal includes a flex region and a conductive path, the conductive path extending from the flex region to the movable contact, the first base terminal extending along the conductive path from the flex region to the movable contact.

18. The switching device in accordance with claim 16, wherein the movable terminal and the first and second base tenuinals form a first circuit assembly, the switching device further comprising a second circuit assembly including different movable, first, and second base terminals.

19. An electrical switching device comprising:

first and second circuit assemblies, each of the first and second circuit assemblies comprising:

a base terminal extending substantially in an axial direction and having a base contact;

a movable terminal extending substantially in the axial direction and having a movable contact, the movable and base terminals of the corresponding circuit assembly extending generally parallel to each other and being separated by a field spacing, the movable terminal being selectively movable to and from the base terminal of the corresponding circuit assembly to electrically connect the base and movable contacts at a contact interface, wherein current flows in opposite directions through the base and movable terminals of the corresponding circuit assembly during operation of the switching device thereby generating an Ampere's separation force that acts to separate said movable and base terminals; and a magnetic shield located between the movable and base terminals of the corresponding circuit assembly within the field spacing, the magnetic shield comprising a magnetic material that reduces the separation force experienced by the movable terminal to facilitate maintaining the contact interface between the base and movable contacts of the corresponding circuit assembly; and an actuator device operatively coupled to the movable terminals of the first and second circuit assemblies, the actuator device selectively moving the movable terminals to electrically connect and disconnect the corresponding movable and base contacts of each of the first and second circuit assemblies.

20. The switching device of claim 19, wherein the actuator device includes an electromechanical motor having a pivot assembly and a coil assembly, the motor being located between the first and second circuit assemblies, the switching device also including a coupling element that operatively couples the movable terminals of the first and second circuit assemblies to the pivot assembly.

* * * * *